US006179176B1

(12) United States Patent
Saggese et al.

(10) Patent No.: US 6,179,176 B1
(45) Date of Patent: Jan. 30, 2001

(54) WHEELABLE BACKPACK

(76) Inventors: Laura Saggese, 33 Evergreen Row, Armonk, NY (US) 10504; John F. Knapp, 16 Sayer St., Goshen, NY (US) 10924

( * ) Notice: Under 35 U.S.C. 154(b), the term of this patent shall be extended for 0 days.

(21) Appl. No.: 09/377,530

(22) Filed: Aug. 19, 1999

(51) Int. Cl.[7] ..... A45F 4/02

(52) U.S. Cl. ..... 224/153; 224/577; 190/18 A; 190/18 R

(58) Field of Search ..... 224/153, 577; 190/18 A, 18 R; 280/43.21, 47.24

(56) References Cited

U.S. PATENT DOCUMENTS

| | | | | |
|---|---|---|---|---|
| 4,368,835 | * | 1/1983 | Murphy | 224/153 |
| 4,524,482 | * | 6/1985 | Mueller | 16/44 |
| 5,447,261 | * | 9/1995 | Mitomi et al. | 224/153 |
| 5,588,569 | * | 12/1996 | Mitomi et al. | 224/153 |
| 5,634,576 | * | 6/1997 | Arbel | 224/153 |
| 5,676,286 | * | 10/1997 | Song | 224/153 |
| 5,743,447 | * | 4/1998 | McDermott | 224/153 |
| 5,749,503 | * | 5/1998 | Wulf et al. | 224/153 |
| 5,758,752 | * | 6/1998 | King et al. | 190/18 A |
| 5,819,892 | * | 10/1998 | Deliman et al. | 190/115 |
| 5,893,495 | * | 4/1999 | Godshaw et al. | 224/153 |
| 5,964,470 | * | 10/1999 | Syendsen et al. | 280/30 |
| 5,984,154 | * | 11/1999 | Scicluna | 224/153 |
| 6,056,301 | * | 5/2000 | Berliner et al. | 280/43.1 |
| 6,095,385 | * | 8/2000 | Utu et al. | 224/153 |

FOREIGN PATENT DOCUMENTS

| | | | |
|---|---|---|---|
| 4202135 | * | 1/1992 | (DE) . |
| 2441358 | * | 7/1980 | (FR) . |
| 2124589 | * | 2/1984 | (GB) . |
| 406217826 | * | 8/1994 | (JP) . |

* cited by examiner

*Primary Examiner*—Stephen F. Gerrity
*Assistant Examiner*—Rhonda E. Sands
(74) *Attorney, Agent, or Firm*—Alfred C. Hill

(57) ABSTRACT

A wheelable backpack having a front portion to carry items therein, a rear portion to rest against the back of a person using the backpack in a back-carrying mode and a pair of shoulder straps to enable the person to use the backpack in the back-carrying mode, a pair of channels substantially parallel to and spaced with respect to each other disposed in a rear portion extending from the top to the bottom of the backpack; a handle device disposed in the pair of channels; a pair of compartments disposed in the bottom portion with each of the pair of compartments being disposed in communication with a different one of the pair of channels; a pair of wheels each disposed in a different one of the pair of compartments; and a mechanical arrangement disposed in each of the pair of channels connected between the handle device and each of the pair of wheels to convert linear motion of the handle means to rotary motion to extend each of the pair of wheels out of their associated one of the pair of compartments when the handle device is pulled outwardly in the pair of channels to enable wheeling the backpack in a wheeled mode and to retract each of the pair of wheels into the associated one of the pair of compartments when the handle device is pushed downwardly in the pair of channels to enable the person to carry the backpack in the back-carrying mode without soiling their clothes.

20 Claims, 8 Drawing Sheets

WHEELABLE BACKPACK

BACKGROUND OF THE INVENTION

The present invention relates to backpacks and more particularly to a wheelable backpack.

The prior art illustrates that it is known to provide wheels for luggage, such as suitcases and trunks, but there has not been found, in the prior art, a wheeled, retractable backpack.

U.S. Pat. No. 4,314,624 discloses a wheeled piece of luggage that has on its back two spaced grooves with tubes being disposed in the groove with a handle at one end of the tubes and a wheel at the other end of each of the tubes, with the wheels being stored in cutouts in the back wall of the suitcase or trunk. The wheels can be turned into a wheelable condition from the cutouts by rotation of the tubes by the use of a helical screw thread and a nut on the end of the tubes which cause the tubes to rotate 90° and thereby rotate the wheels out of the wheel cutouts.

U.S. Pat. No. 4,254,850 illustrates another arrangement for trunks and luggage having retractable wheels connected to a handle. The motion of each wheel is controlled by a cam slot so that the wheel moves out when the handle is extended, but returns to a storage position when the handle is retracted.

U.S. Pat. No. 4,588,055 discloses another arrangement for towing luggage, such as a suitcase or a trunk. In this patent the wall of the luggage includes a pair of fixed tubes, a pair of push pull tubes and a U-shaped tube wherein each end of the U-shaped tubes is connected to the push pull tubes. A pair of levers, one end of each being overlapped and hinged on the middle of the U-shaped tube and a pair of reverse L-shaped lengths which are fulcrumed at their angled part and are hinged on the other ends of the levers. By pushing down and pulling up the handle, the wheel units can be extended outward or retracted inward.

Each of these prior art arrangements, are relatively complex particularly the last patent, U.S. Pat. No. 4,588,055. There is no teaching in any of these patents, or other prior art patents uncovered in a search, that the techniques for the wheeling of trunks and suitcases can be adapted for use with a knapsack or backpack which is carried either by a pair of shoulder straps on the back of the person using the backpack or capable of being wheeled if the person so desires.

SUMMARY OF THE INVENTION

An object of the present invention is to provide a retractable wheeled backpack.

Another object of the present invention is to provide a wheeled backpack having a simple arrangement to enable the wheels to be extended outwardly or retracted inwardly.

A further object of the present invention is the provision of an arrangement to enable the wheeling of a backpack wherein the wheels when being used as a backpack are retracted into a compartment in the lower portion of the backpack to prevent dirt on the wheels to be transferred to the clothes of the person that may use the backpack in its conventional manner, namely, by the use of the shoulder strap supporting the backpack to the back of the user.

A feature of the present invention is the provision of a wheelable backpack comprising a backpack having a front portion to carry items therein, a rear portion to rest against a back of a person using the backpack in a back-carrying mode, a top portion and a bottom portion; a pair of channels substantially parallel to and spaced with respect to each other disposed in the rear portion extending from the top portion to the bottom portion; handle means disposed in the pair of channels; a pair of compartments disposed in the bottom portion, each of the pair of compartments being disposed in communication with a different one of the pair of channels; a pair of wheels each disposed in a different one of the pair of compartments; and mechanical means disposed in each of the pair of channels connected between the handle means and each of the pair of wheels to convert linear motion of said handle means to rotary motion to extend each of the pair of wheels out of their associated one of the pair of compartments when the handle means is pulled outwardly in the pair of channels to enable wheeling the backpack in a wheeled mode and to retract each of the pair of wheels into an associated one of the pair of compartments when the handle means is pushed downwardly in the pair of channels to enable the person to carry the backpack in their back-carrying mode without soiling the clothes of the person.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
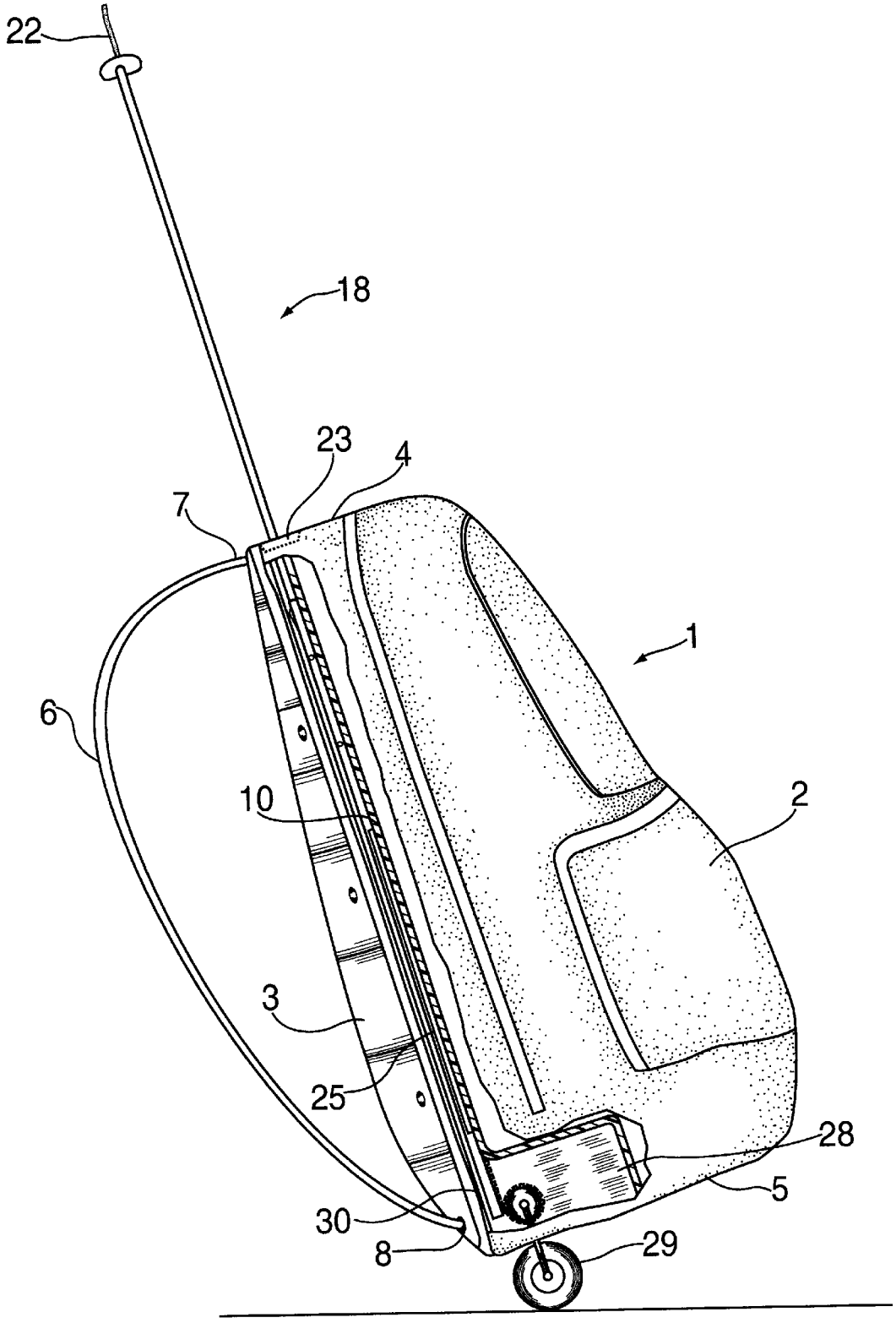
FIG. 1 is a side elevational view of the wheeled backpack in accordance with the principles of the present invention with a portion thereof removed to disclose the mechanism for controlling the wheels of the backpack.
Figure 2:
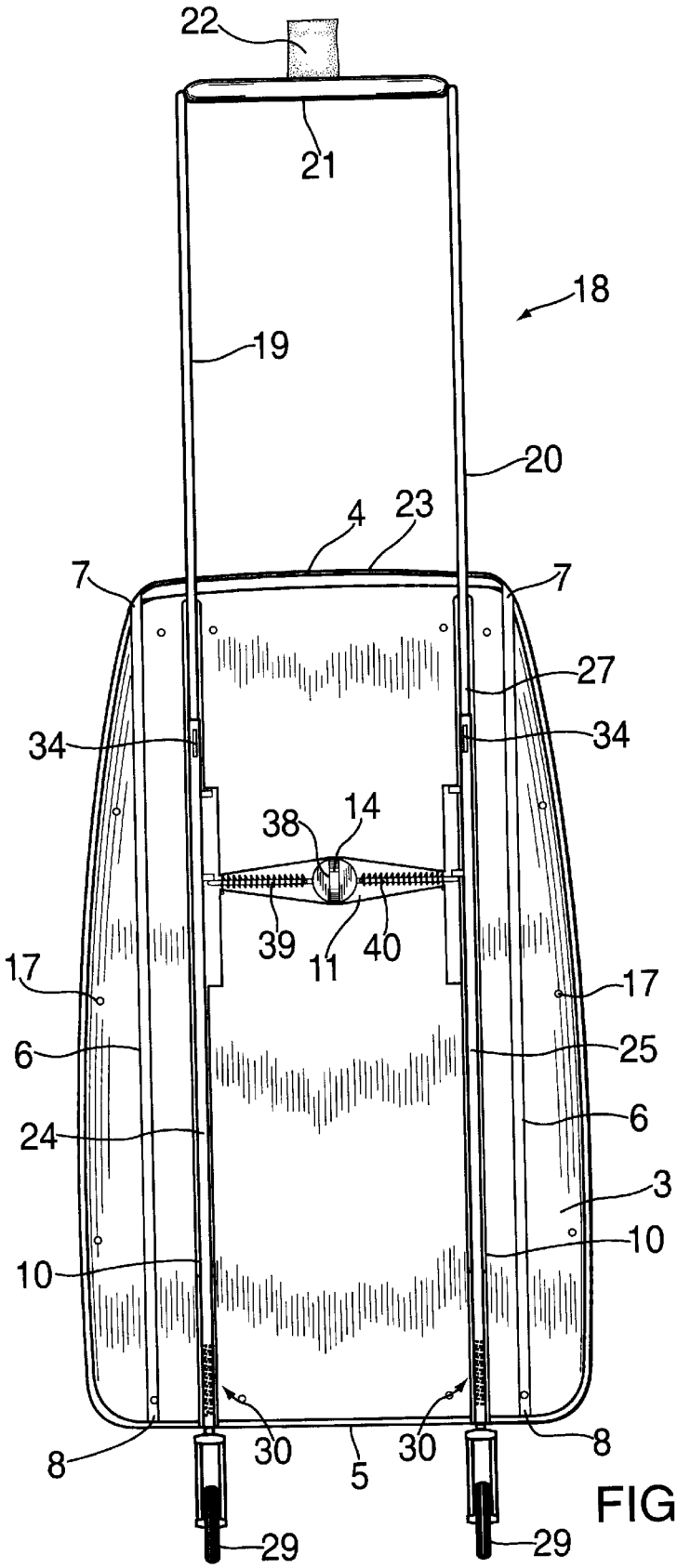
FIG. 2 is a back elevational view of the wheeled backpack in accordance with the principles of the present invention.

Referring to FIGS. 1–5, the wheelable backpack in accordance with the principles of the present invention includes a backpack 1 having a front portion 2 to carry items therein, such as clothing, food and the like, a rear a portion 3 to rest against a back of a person using backpack 1 in a back-carrying mode, a top portion 4, a bottom portion 5 and a pair of shoulder straps 6 spaced with respect to each other to enable the person to use the backpack 1 in the back-carrying mode, each of the pair of shoulder straps 6 having one end 7 fastened to the rear portion 3 adjacent the top portion 4 and the other end 8 fastened to the rear portion 3 adjacent the bottom portion 5.

Figure 4:
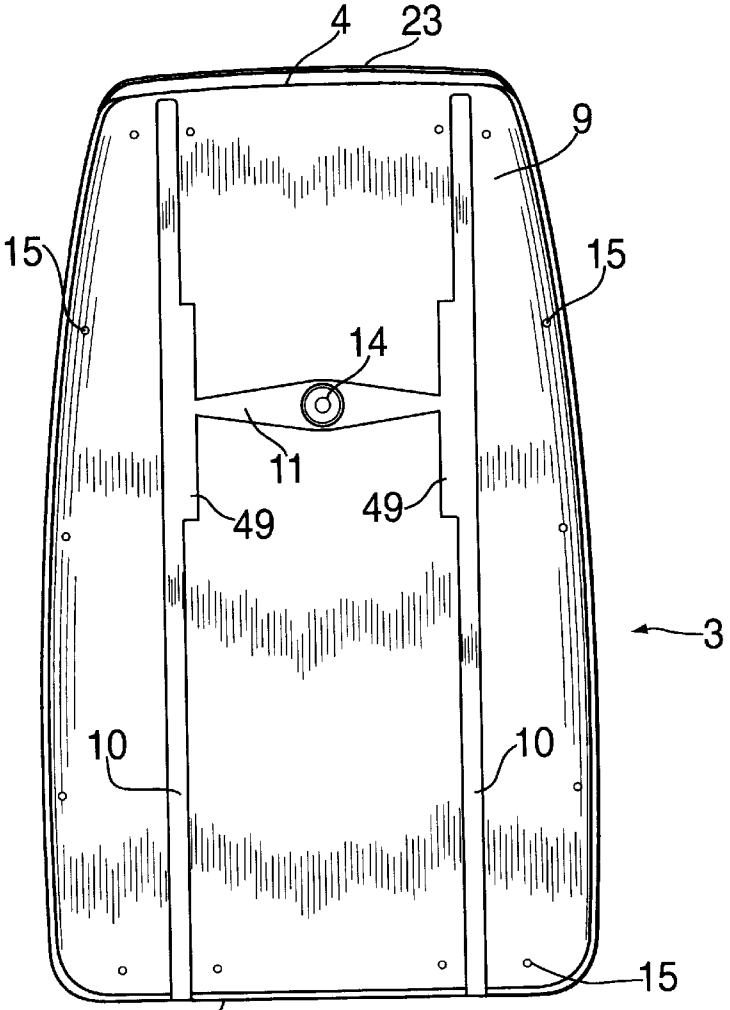
FIG. 4 is a plan view of the inner back shell of the wheeled backpack in accordance with the principles of the present invention.
Figure 3:
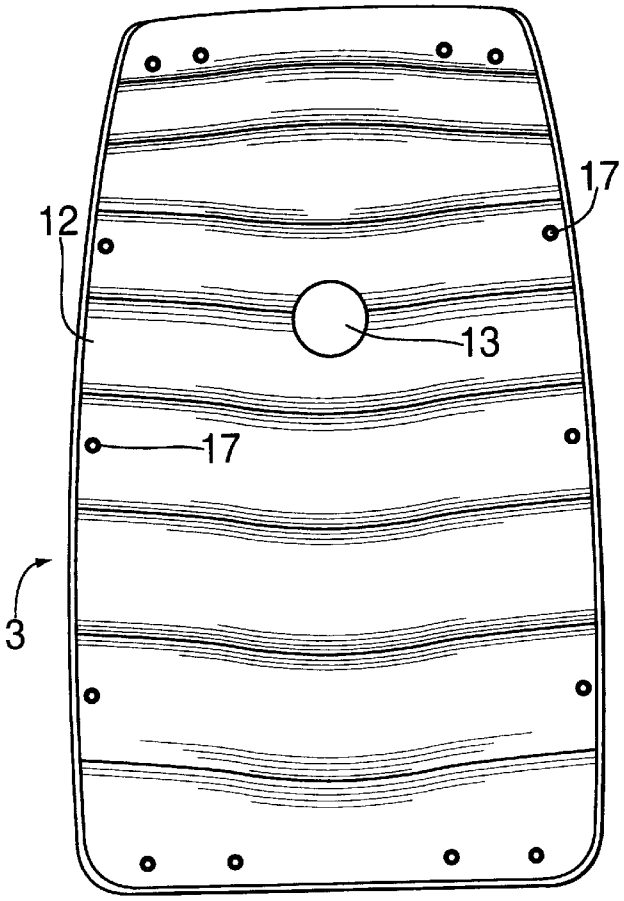
FIG. 3 is a plan view of the outer back shell of the backpack in accordance with the principles of the present invention.
Figure 5:
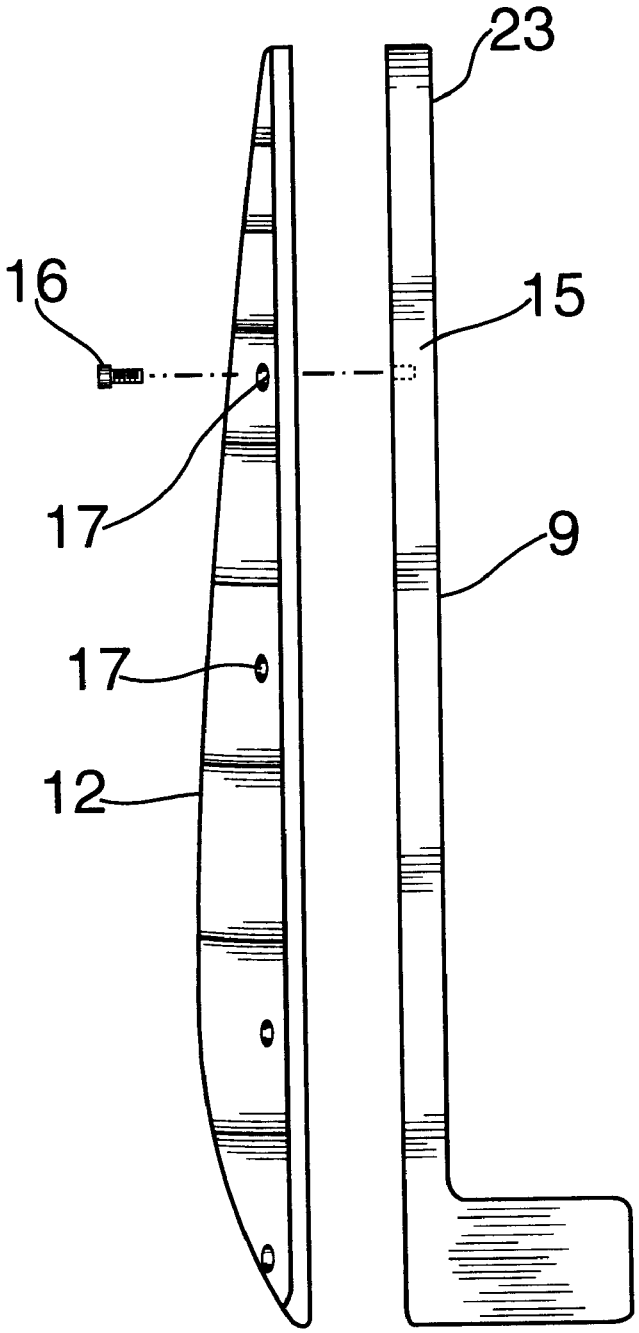
FIG. 5 is a side elevational view of the shells of FIGS. 3 and 4.

As best seen in FIGS. 3–5, the rear portion 3 includes an inner back shell 9 made of hard rubberized plastic material having a pair of channels 10 substantially parallel to and spaced with respect to each other extending from the top portion 4 to the bottom portion 5 and a recess 11 connecting channels 10 is provided to hold a spring loaded knob assembly to be explained hereinbelow. Rear portion 3 further includes an outer back shell 12 having a large aperture 13 to provide access to the knob 14 of the spring loaded assembly contained in recess 11. Threaded holes are provided in the inner back shell 9 as shown at 15 positioned or oriented to receive the alien head screws 16 passed through the recess apertures 17 to secure the outer back shell 12 to the inner back shell 9. The outer back shell 12 is made of a soft rubberized plastic material so as to provide comfort for the person when the person employs the backpack 1 in the back-carrying mode.

Handle means 18 is U-shaped having a pair of legs 19 and 20 with each of the pair of legs being disposed in a different one of the pair of channels 10 and a cross member 21 interconnecting the legs 19 and 20. Cross member 21 provides a grip for the handle means 18 with a fabric tab 22 being fastened to cross member 21 to facilitate pulling the handle means 18 out of a top groove or recess 23 in the top portion 4 of the backpack 1. The fabric tab 22 can be nylon or any other suitable flexible material.

More specifically handle means 18 includes a first pair of tubular members 24 and 25 each disposed in a different one of the pair of channels 10 and a second pair of tubular members 26 and 27 each telescoping into a different one of the first pair of members 24 and 25.

A pair of compartments 28 are disposed in the bottom portion 5 with each of the pair of compartments 28 being disposed in communication with a different one of the pair of channels 10. Each of a pair of wheels 29 are disposed in a different one of the pair of compartments 28.

A mechanical means 30 is disposed in each of the pair of channels 10 connected between the handle means 18 and each of the pair of wheels 29 to convert linear motion of the handle means 18 to rotary motion to extend each of the pair of wheels 29 out of their associated one of the pair of compartments 28 when the handle means is pulled outwardly in the pair of channels 10 to enable wheeling the backpack in a wheeled mode and to retract each of the pair of wheels 29 into the associated one of the pair of compartments 28 when the handle means 18 is pushed downwardly in the pair of channels to enable the person to carry the backpack in the back-carrying mode without soiling the persons clothes.

Figures 6A, 6B, 6C:
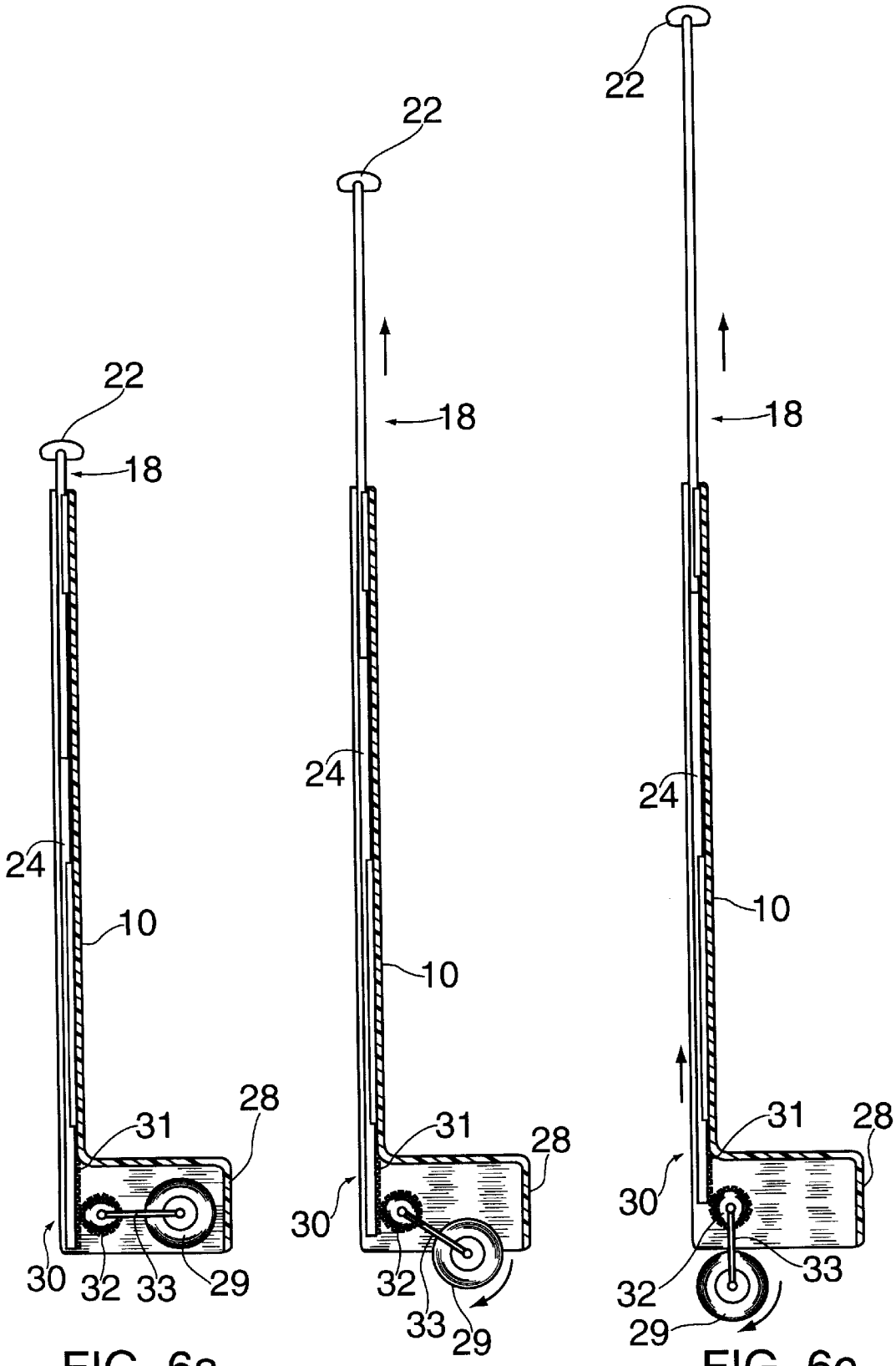
FIGS. 6*a,* 6*b* and 6*c* are side partially sectional illustrations of the operation of the handle extension and wheel lowering mechanism contained in the back portion of the wheeled backpack in accordance with the principles of the present invention.

More specifically, as best seen in FIGS. 6*a*–6*c*, the mechanical means 30 includes a rack 31 connected to the outer tubular members 24 and 25 and a gear 32 connected to the wheels 29 through a linkage 33. The teeth of gear 32 engage the teeth of rack 31 so that when the handle means 18 is pulled from the channels 10 the wheels 29 are rotated from the position shown in FIG. 6*a* to that shown in FIGS. 6*b* and 6*c*. When the handle means 18 is pushed into the channels 10 the reverse action occurs causing the wheels 29 to be moved from the extended position of FIG. 6*c* to the retracted position of FIG. 6*a*.

Figures 7A, 7B:
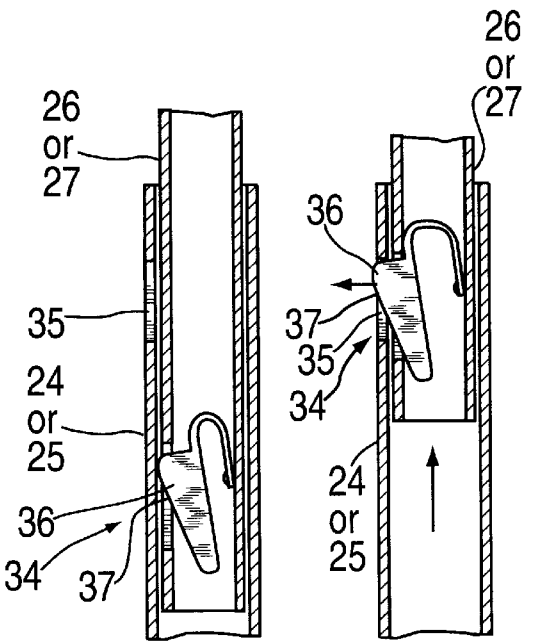
FIGS. 7*a* and 7*b* are detailed cross-sectional views through the inner and outer members of the wheeled backpack showing the catch mechanism in accordance with the principles of the present invention.

A latch mechanism 34 is provided between each of the associated one of the outer tubular members 24 and 25 and the inner tubular members 26 and 27 to enable movement of members 24 and 25 by movement of members 26 and 27. This latch mechanism 34 is an umbrella style latch mechanism more specifically shown in FIGS. 7*a* and 7*b*. The latch mechanism 34 is located near the top of the outer tubular members 24 and 25. Tubular members 24 and 25 are provided with an aperture 35 and the inner tubular members 26 and 27 includes an outwardly biased spring loaded catch 36. When the inner members 26 and 27 are pulled so that the catch 36 can enter the aperture 35 in the outer members 24 and 25, the inner members 26 and 27 are locked to outer members 24 and 25 for movement thereof so that the backpack 1 can be operated in the wheeled mode. The sloping surface 37 of the catch 36 allows the user to push the inner members 26 and 27 into the outer members 24 and 25 thereby releasing catch 36.

Figure 8C:
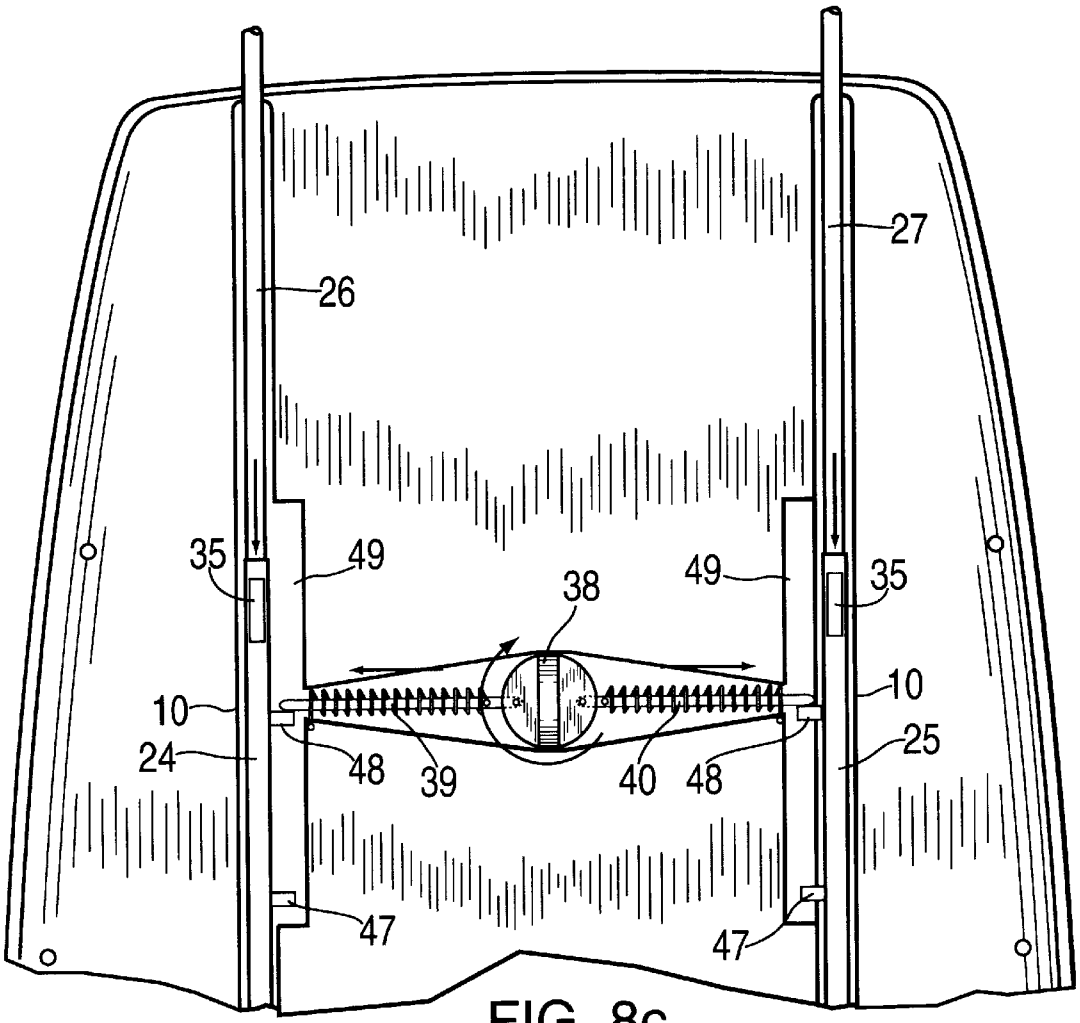
FIGS. 8*a,* 8*b* and 8*c* are detailed illustrations of the mechanism to control the operation of the handle of the wheeled backpack in accordance with the principles of the present invention.
Figure 8A:
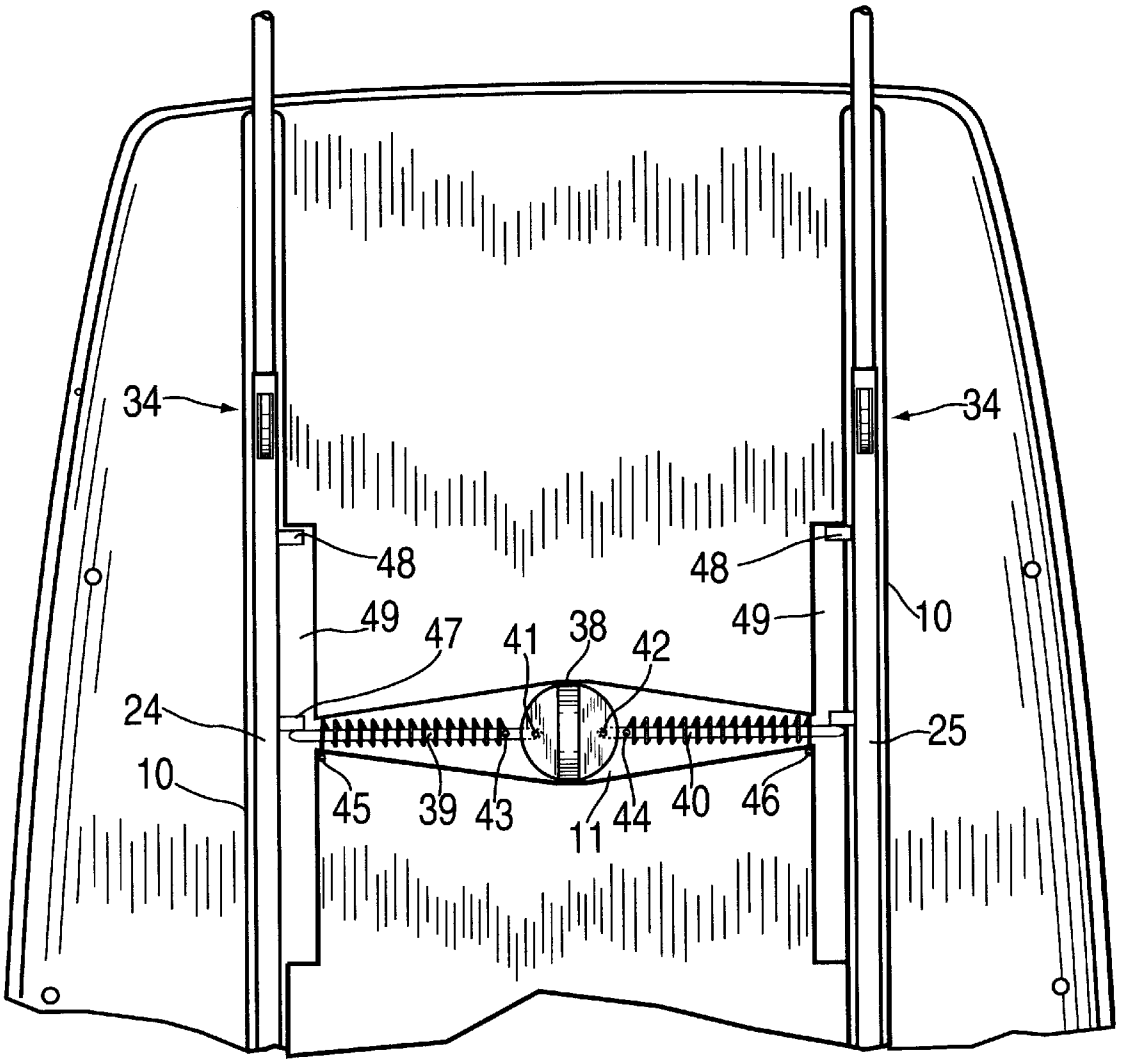
Figure 8B:
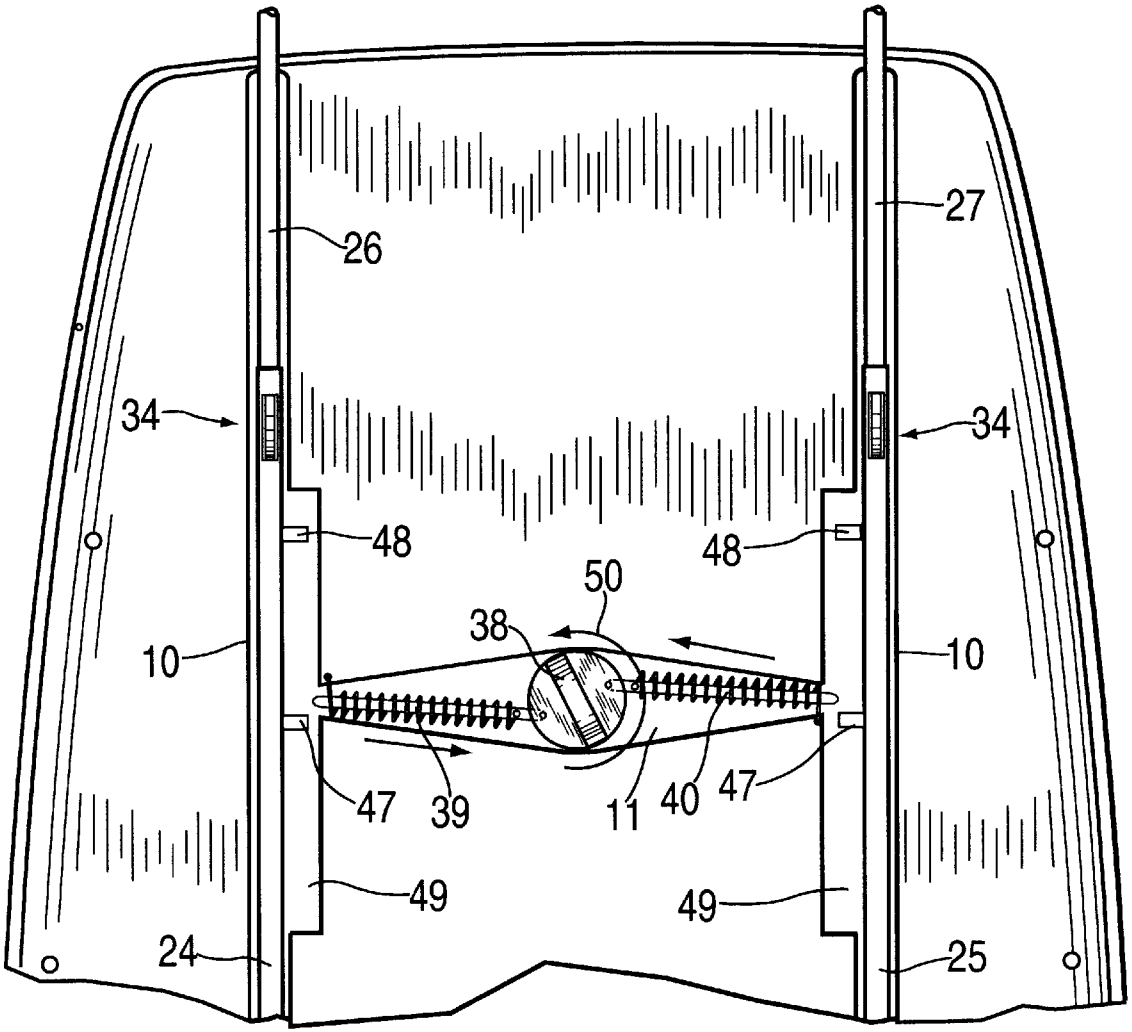

FIGS. 8*a*–8*c*, show in detail the components contained in recess 11. Recess 11 includes a knob 38 in knob recess 14 and a pair of spring loaded rods 39 and 40. The rods 39 and 40 are mounted at pivot points 41 and 42 at the back of knob 38 with springs 39 and 40 being attached at points 43 and 44 and 45 and 46, respectively. With the spring loaded rods 39 and 40 in the position illustrated in FIGS. 2 and 8*a*, the spring loaded rods 39 and 40 are outwardly biased to engage the lower stops 47 on outer members 24 and 25. The upper stops 48 and lowers stops 47 carried by the outer tubular members 24 and 25 travel in the cutout portion 49 in the inner back shell 9.

Knob 38 enables the user to select either a wheeled mode or a back-carrying mode by moving the spring loaded rods 39 and 40. As indicated in FIG. 8*b*, when the knob 38 is rotated in the direction of the arrow 50 spring loaded rods 39 and 40 are moved away from stops 47 enabling the movement of members 26, 24, and 27, 25 downwardly until the point at which the stops 48 are beyond the location of the spring rods 39 and 40 to then lock the rods in position when the knob 38 is released and the springs on spring rods 39 are 40 cause the rods to move outwardly to reengage the member at the upper stops 48 as indicated in FIG. 8*c*. Downward motion of members 24 and 25 move rack 31 downward which rotates gears 32 to move wheels 29 out of compartments 28. When knob 38 is rotated again and handle 18 is moved upward, member 25 will move upward until the position shown in FIG. 8*a* is again achieved. Upward movement of member 25 will move rack 31 to rotate gear 32 to return wheels 29 to compartment 28.

While the gear 32 is shown to be a pinion type gear, a worm gear could also be substituted to engage the rack who has cantered teeth to compliment the worm gear teeth so that again we have the conversion of liner motion to rotary motion to cause the wheels 29 to either be extended from compartments 28 or retracted into compartments 28 to provide the ability for the user to place the backpack 1 in a backpack-carry mode with the wheels 29 disposed in the compartments 28 so that the person using the backpack in the back-carry mode will not have their clothes soiled by dirt on the wheels 29 which may be picked up when the wheels 29 are extended to provide the wheeled mode for the backpack 1.

While we have described above the principles of our invention in connection with specific apparatus, it is to be clearly understood that this description is made only by way of example and not as a limitation to the scope of our invention as set forth in the objects thereof and in the accompanying claims.

We claim:

1. A wheelable backpack comprising:

a backpack having a front portion to carry items therein, a rear portion to rest against a back of a person using said backpack in a back-carrying mode, a top portion, a bottom portion and a pair of shoulder straps spaced with respect to each other to enable said person to use said backpack in said back-carrying mode, each of said pair of shoulder straps having one end fastened to said rear portion adjacent said top portion and the other end fastened to said rear portion adjacent said bottom portion;

a pair of channels substantially parallel to and spaced with respect to each other disposed in said rear portion extending from said top portion to said bottom portion;

handle means disposed in said pair of channels;

a pair of compartments disposed in said bottom portion, each of said pair of compartments being disposed in communication with a different one of said pair of channels;

a pair of wheels each disposed in a different one of said pair of compartments; and mechanical means disposed in each of said pair of channels connected between said handle means and each of said pair of wheels to convert linear motion of said handle means to rotary motion to extend each of said pair of wheels out of their associated one of said pair of compartments when said handle means is pulled outwardly in said pair of channels to enable wheeling said backpack in a wheeled mode and to retract each of said pair of wheels into said associated one of said pair of compartments when said handle means is pushed downwardly in said pair of channels to enable said person to carry said backpack in said back-carrying mode without soiling clothes of said person.

2. A backpack according to claim 1, wherein said handle means includes a U-shaped handle having a pair of legs, each of said pair of legs being disposed in a different one of said pair of channels and a cross member interconnecting an end of each of said pair of legs remote from said pair of channels to provide a grip for said handle means.

3. A backpack according to claim 2, wherein said top portion contains a recess therein to receive said cross member when said backpack is in said back-carrying mode.

4. A backpack according to claim 3, further including a fabric tab secured to said cross member to facilitate pulling said cross member from said recess.

5. A backpack according to claim 4, wherein said mechanical means includes a rack connected to each of said pair of legs, and a gear connected to each of said pair of wheels, teeth of said gear engaging teeth of said rack.

6. A backpack according to claim 3, wherein said mechanical means includes a rack connected to each of said pair of legs, and a gear connected to each of said pair of wheels, teeth of said gear engaging teeth of said rack.

7. A backpack according to claim 2, wherein said mechanical means includes a rack connected to each of said pair of legs, and a gear connected to each of said pair of wheels, teeth of said gear engaging teeth of said rack.

8. A backpack according to claim 1, wherein said handle means includes a first pair of tubular members each disposed in a different one of said pair of channels, a second pair of tubular members each telescoping into a different one of said first pair of tubular members, and a cross member interconnecting said second pair of tubular members spaced from said first pair of tubular members to provide a grip for said handle means.

9. A backpack according to claim 8, wherein said top portion contains a recess therein to receive said cross member when said backpack is in said back-carrying mode.

10. A backpack according to claim 9, further including a fabric tab secured to said cross member to facilitate pulling said cross member from said recess.

11. A backpack according to claim 10, wherein said mechanical means includes a rack connected to each of said first pair of tubular members, and a gear connected to each of said pair of wheels, teeth of said gear engaging teeth of said rack.

12. A backpack according to claim 11, further including a pair of latch mechanisms each associated with a different one of associated ones of each of said first pair of tubular members and said second pair of tubular members to maintain said second pair of tubular members extended when said backpack is in said wheeled mode.

13. A backpack according to claim 12, further including a pair of spring loaded rods disposed in said rear portion extending in opposite directions, one end of each of said pair of spring load rods being associated with stops connected to a different one of said first pair of tubular members, and a knob disposed in said rear portion connected to the other end of each of said pair of spring loaded rods to enable a user to select either one of said wheeled mode and said back-carrying mode.

14. A backpack according to claim 8, wherein said mechanical means includes a rack connected to each of said first pair of tubular members, and a gear connected to each of said pair of wheels, teeth of said gear engaging teeth of said rack.

15. A backpack according to claim 14, further including a pair of latch mechanisms each associated with a different one of associated ones of each of said first pair of tubular members and said second pair of tubular members to maintain said second pair of tubular members extended when said backpack is in said wheeled mode.

16. A backpack according to claim 15, further including a pair of spring loaded rods disposed in said rear portion extending in opposite directions, one end of each of said pair of spring load rods being associated with stops connected to a different one of said first pair of tubular members, and a knob disposed in said rear portion connected to the other end of each of said pair of spring loaded rods to enable a user to select either one of said wheeled mode and said back-carrying mode.

17. A backpack according to claim 8, further including a pair of latch mechanisms each associated with a different one of associated ones of each of said first pair of tubular members and said second pair of tubular members to maintain said second pair of tubular members extended when said backpack is in said wheeled mode.

18. A backpack according to claim 17, further including a pair of spring loaded rods disposed in said rear portion extending in opposite directions, one end of each of said pair of spring load rods being associated with stops connected to a different one of said first pair of tubular members, and a knob disposed in said rear portion connected to the other end of each of said pair of spring loaded rods to enable a user to select either one of said wheeled mode and said back-carrying mode.

19. A backpack according to claim 8, further including a pair of spring loaded rods disposed in said rear portion extended in opposite directions, one end of each of said pair of spring load rods being associated with stops connected to a different one of said first pair of tubular members, and a knob disposed in said rear portion connected to the other end of each of said pair of spring loaded rods to enable a user to select either one of said wheeled mode and said back-carrying mode.

20. A backpack according to claim 19, wherein said mechanical means includes a rack connected to each of said first pair of tubular members, and a gear connected to each of said pair of wheels, teeth of said gear engaging teeth of said rack.

* * * * *